US011371788B2

(12) United States Patent
Johns et al.

(10) Patent No.: US 11,371,788 B2
(45) Date of Patent: Jun. 28, 2022

(54) HEAT EXCHANGERS WITH A PARTICULATE FLUSHING MANIFOLD AND SYSTEMS AND METHODS OF FLUSHING PARTICULATES FROM A HEAT EXCHANGER

(71) Applicant: General Electric Company, Schenectady, NY (US)

(72) Inventors: Matthew Ryan Johns, Centerville, OH (US); William Lewis Schneider, Cincinnati, OH (US); Eliezer Manuel Alcantara-Marte, Liberty Township, OH (US); Dylan Thomas Gerding, Amelia, OH (US)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 16/126,340

(22) Filed: Sep. 10, 2018

(65) Prior Publication Data

US 2020/0080799 A1 Mar. 12, 2020

(51) Int. Cl.

| | |
|---|---|
| ***F28G 1/16*** | (2006.01) |
| ***F28D 9/00*** | (2006.01) |
| ***F28D 21/00*** | (2006.01) |

(52) U.S. Cl.

CPC ..... *F28G 1/163* (2013.01); *F28D 9/0062* (2013.01); *F28D 2021/008* (2013.01); (Continued)

(58) Field of Classification Search

CPC ..... F28G 1/163; F28G 9/00; F28D 9/0062; F28D 2021/0049; F28D 2021/0057

See application file for complete search history.

(56) References Cited

U.S. PATENT DOCUMENTS 1,903,650 A * 4/1933 Snow ..... F24H 9/0036 165/95
1,939,394 A * 12/1933 Harpster ..... F28G 1/166 165/95

(Continued)

FOREIGN PATENT DOCUMENTS

EP 0029933 B1 5/1983
EP 2447046 A2 5/2012

(Continued)

OTHER PUBLICATIONS

International Search Report Corresponding to Application No. PCT/US2019/050163 dated Nov. 12, 2019.

(Continued)

*Primary Examiner* — Ljiljana V. Ciric
(74) *Attorney, Agent, or Firm* — Dinsmore & Shohl LLP

(57) ABSTRACT

A heat exchanger including a body. The body includes a plurality of heat transfer pathways, and a flushing manifold formed with the body of the heat exchanger. The flushing manifold includes a plurality of nozzles oriented so as to spray a flushing fluid onto, into, or both onto and into one or more of the plurality of heat transfer pathways. A method of flushing particulates from a heat exchanger including supplying a flushing fluid through a flushing manifold formed with a body of a heat exchanger, and spraying the flushing fluid onto, into, or both onto and into one or more heat transfer pathways using one or more nozzles in fluid communication with the flushing manifold.

7 Claims, 10 Drawing Sheets

(52) U.S. Cl.
CPC ..... *F28D 2021/0021* (2013.01); *F28D 2021/0049* (2013.01); *F28D 2021/0089* (2013.01)

(56) References Cited

U.S. PATENT DOCUMENTS 1,978,555 A * 10/1934 Snow ..... F28G 3/163 165/95
2,069,574 A * 2/1937 Bowers ..... F28G 15/08 165/95
2,158,792 A * 5/1939 Erbach ..... F25B 39/028 62/212
2,351,163 A * 6/1944 Thomas ..... F28G 7/00 122/379
2,421,293 A * 5/1947 Shawhan ..... F25D 21/10 62/81
2,568,891 A * 9/1951 Kals ..... B01D 47/06 261/140.1
2,685,293 A * 8/1954 Dauphinee ..... B24C 3/18 134/153
2,918,925 A * 12/1959 Dopler ..... F28G 9/00 134/108
2,935,429 A * 5/1960 Grotlisch ..... F28G 9/00 134/22.12
3,037,887 A * 6/1962 Brenner ..... B08B 3/003 134/22.18
3,225,777 A * 12/1965 Shelton ..... F28G 9/00 134/141
3,295,596 A * 1/1967 Ostrofsky ..... F28G 7/00 165/84
3,364,983 A * 1/1968 Mas ..... F28G 7/00 165/84
3,645,420 A * 2/1972 Machado ..... F24H 3/06 222/23
3,828,570 A * 8/1974 Stutz ..... F25D 21/10 62/282
3,913,531 A * 10/1975 von Hollen ..... F28D 7/06 122/32
3,916,844 A * 11/1975 Cassell ..... F22B 37/228 122/32
4,025,362 A * 5/1977 Frauenfeld ..... D06N 3/142 134/57 R
4,127,160 A * 11/1978 Joffe ..... F01P 11/06 165/95
4,141,754 A * 2/1979 Frauenfeld ..... F28G 9/005 134/102.1
4,161,979 A * 7/1979 Stearns ..... F01P 11/06 123/198 R
4,196,020 A * 4/1980 Hornak ..... B08B 3/02 134/167 R
4,273,076 A * 6/1981 Lahoda ..... F22B 37/483 122/382
4,320,528 A * 3/1982 Scharton ..... F22B 37/483 134/1
4,332,292 A * 6/1982 Garberick ..... F28G 1/16 134/172
4,366,003 A * 12/1982 Korte ..... F28G 9/00 134/18
4,390,034 A * 6/1983 Bes ..... F22B 37/483 134/104.1
4,390,049 A * 6/1983 Albertson ..... B08B 9/0323 123/41.42
4,396,434 A * 8/1983 Forster ..... B08B 7/0007 134/1
4,415,369 A * 11/1983 Allmendinger ..... F28G 9/00 134/117
4,423,601 A * 1/1984 Kramer ..... F25D 21/10 62/282
4,424,769 A * 1/1984 Charamathieu ..... F28G 15/04 122/392
4,492,186 A * 1/1985 Helm ..... F22B 37/483 122/382
4,551,181 A * 11/1985 Stearman ..... F28G 9/00 134/22.11
4,562,885 A * 1/1986 Pausch ..... F28G 1/166 15/318.1
4,577,680 A * 3/1986 Clem ..... F28G 13/00 165/95
4,589,898 A * 5/1986 Beaver ..... C03B 37/02 134/2
4,629,128 A * 12/1986 Lawrence ..... B05B 1/005 134/166 R
4,645,542 A * 2/1987 Scharton ..... B08B 9/0326 134/1
4,655,846 A * 4/1987 Scharton ..... F28G 7/005 134/1
4,666,531 A * 5/1987 Minard ..... F28G 9/00 134/26
4,699,665 A * 10/1987 Scharton ..... F22B 37/483 134/1
4,703,793 A * 11/1987 Townsend ..... F28G 11/00 134/22.11
4,750,547 A * 6/1988 Sakamoto ..... F28G 9/00 122/390
4,773,357 A * 9/1988 Scharton ..... F22B 37/483 122/382
4,790,882 A * 12/1988 Barres ..... F01P 11/06 123/41.21
4,809,513 A * 3/1989 Goldstein ..... F25D 3/00 62/434
4,827,953 A * 5/1989 Lee ..... F22B 37/483 122/392
4,846,894 A * 7/1989 Clem ..... F28G 13/00 134/1
4,853,014 A * 8/1989 Bloch ..... B08B 9/0325 96/228
4,884,416 A * 12/1989 Hwang ..... F24F 8/10 62/303
4,886,112 A * 12/1989 Vinson ..... B24C 1/00 165/95
4,899,697 A * 2/1990 Franklin ..... F22B 37/483 122/379
4,921,662 A * 5/1990 Franklin ..... F22B 37/483 122/382
4,972,804 A * 11/1990 Stolmar ..... F22B 1/025 122/379
4,991,608 A 2/1991 Schweiger
4,999,167 A * 3/1991 Skelley ..... B01D 53/60 422/175
5,019,329 A * 5/1991 Franklin ..... F28G 7/00 376/316
5,065,703 A * 11/1991 Lee ..... F28G 15/04 122/382
5,092,355 A * 3/1992 Cadwell ..... G21F 9/001 134/1
5,101,775 A * 4/1992 Hubbs ..... F01P 9/02 123/41.01
5,186,240 A * 2/1993 Kennon ..... F28G 3/166 134/172
5,195,334 A * 3/1993 Lang ..... F28G 1/166 62/303
5,211,028 A * 5/1993 Remo ..... F28G 1/02 165/94
5,257,296 A * 10/1993 Buford, III ..... G21C 17/00 376/310
5,279,357 A * 1/1994 Kennon ..... F28G 3/166 122/391
5,443,085 A * 8/1995 Huddas ..... B08B 9/00 134/103.1
5,529,471 A 6/1996 Khoshevis
5,615,695 A * 4/1997 Chambers ..... B08B 9/0321 134/102.1
5,656,230 A 8/1997 Khoshevis
5,680,877 A * 10/1997 Edstrand ..... B08B 9/032 134/103.1
5,706,841 A * 1/1998 Werre ..... B08B 9/0325 134/103.1
5,837,960 A 11/1998 Lewis et al.

(56) References Cited

U.S. PATENT DOCUMENTS 5,840,100 A * 11/1998 Arencibia, Jr. ..... B01D 47/06 95/225
5,846,285 A * 12/1998 Srinivasan ..... C03B 37/0206 65/498
5,879,466 A * 3/1999 Creger ..... F01P 11/06 134/18
5,897,825 A 4/1999 Fruth et al.
5,924,478 A * 7/1999 Crocker ..... F28G 9/00 165/95
6,050,227 A * 4/2000 LaMotte ..... F28G 3/166 122/379
6,290,778 B1 * 9/2001 Zugibe ..... B08B 3/12 134/1
6,293,121 B1 * 9/2001 Labrador ..... B64C 31/06 62/304
6,318,108 B1 * 11/2001 Holstein ..... F24F 1/06 62/279
6,385,987 B2 * 5/2002 Schlom ..... F28C 1/14 62/304
6,471,800 B2 10/2002 Jang et al.
6,666,038 B1 * 12/2003 Hynes ..... F24F 11/30 62/171
6,764,030 B2 * 7/2004 Habib ..... F28G 1/16 122/379
6,820,575 B2 * 11/2004 Ashton, III ..... F22B 37/483 122/379
6,978,793 B1 * 12/2005 Krueger ..... F28F 3/083 134/109
6,988,374 B2 * 1/2006 Chang ..... F25B 39/02 165/133
6,995,033 B2 2/2006 Prior
7,013,953 B2 * 3/2006 Jung ..... F28G 1/166 165/95
7,017,592 B2 * 3/2006 Chiles ..... F23G 7/068 134/22.1
7,056,442 B2 * 6/2006 Hansen ..... F01P 11/06 134/102.2
7,086,249 B2 * 8/2006 Bae ..... F28F 9/0265 62/504
7,132,017 B2 * 11/2006 Laurence ..... B08B 3/02 134/30
7,381,921 B2 6/2008 Hagemeister et al.
7,418,997 B2 * 9/2008 Martin ..... F28G 9/00 15/405
7,435,072 B2 10/2008 Collins et al.
7,493,938 B2 * 2/2009 Majarais ..... F22B 37/003 134/22.15
7,510,662 B1 * 3/2009 Hansen ..... F01P 11/06 134/102.2
7,666,043 B1 2/2010 Anderson
7,846,260 B2 12/2010 Jiang et al.
8,470,234 B2 6/2013 Clark
8,506,836 B2 8/2013 Szuromi et al.
8,628,628 B1 1/2014 Bonner et al.
8,684,069 B2 4/2014 Mottin et al.
8,974,607 B2 * 3/2015 Al-Otaibi ..... F28G 1/166 134/166 R
9,033,700 B2 * 5/2015 Simard ..... F27D 17/00 431/215
9,091,485 B2 * 7/2015 Bugler, III ..... F28F 25/06
9,334,788 B2 * 5/2016 Stone ..... F01P 11/06
9,568,260 B2 * 2/2017 Stone ..... F28G 1/166
9,587,894 B2 3/2017 Nilsson et al.
9,707,506 B2 * 7/2017 Sogaard ..... B01D 53/79
9,958,212 B2 5/2018 Lv et al.
9,958,221 B2 5/2018 Blomgren
10,018,432 B2 * 7/2018 Stickling ..... F28G 15/02
10,082,350 B2 * 9/2018 Stone ..... F01P 11/06
10,125,976 B2 * 11/2018 Hawkins ..... F22B 37/483
10,365,039 B2 * 7/2019 Wie ..... F26B 21/06
10,365,053 B2 * 7/2019 Billings ..... B05B 13/0278
10,907,914 B2 * 2/2021 Al-Otaibi ..... B08B 9/0323
11,105,569 B2 * 8/2021 Pess ..... F28G 15/02
2002/0062909 A1 5/2002 Jang et al.
2004/0084814 A1 5/2004 Boyd et al.
2006/0118532 A1 6/2006 Chung et al.
2007/0125520 A1 * 6/2007 Nutsos ..... F28G 1/166 165/95
2007/0240446 A1 * 10/2007 Holtzapple ..... B01D 3/065 62/333
2008/0175424 A1 7/2008 McBagonluri et al.
2009/0211612 A1 * 8/2009 Athanassiu ..... F28G 15/04 134/54
2010/0229953 A1 * 9/2010 Stuart ..... F28G 9/00 137/1
2010/0242516 A1 * 9/2010 Seo ..... F28C 1/16 165/96
2012/0018926 A1 1/2012 Mannella et al.
2012/0060759 A1 * 3/2012 Moore ..... B01J 6/008 118/723 E
2012/0061055 A1 * 3/2012 Bugler, III ..... F28C 1/14 165/104.13
2012/0067546 A1 * 3/2012 Bugler, III ..... F28C 1/14 165/59
2013/0071562 A1 3/2013 Szuromi et al.
2013/0101746 A1 4/2013 Keremes et al.
2013/0316084 A1 11/2013 Szuromi et al.
2013/0319464 A1 12/2013 Barrett
2014/0238437 A1 8/2014 Tomkins et al.
2014/0251481 A1 9/2014 Kroll et al.
2014/0252684 A1 9/2014 Swanson et al.
2014/0335313 A1 11/2014 Chou et al.
2015/0273631 A1 10/2015 Kenney et al.
2016/0054070 A1 2/2016 Calton
2017/0120536 A1 5/2017 Brunermer et al.
2017/0232670 A1 8/2017 Joerger et al.
2017/0363377 A1 12/2017 Phillips
2018/0043482 A1 2/2018 Vos et al.
2019/0017431 A1 * 1/2019 Hilakari ..... F02B 29/0493
2021/0123697 A1 * 4/2021 Al-Otaibi ..... B08B 3/08

FOREIGN PATENT DOCUMENTS

EP 3053720 A1 8/2016
GB 563073 A 7/1944

OTHER PUBLICATIONS

International Searching Authority Written Opinion Corresponding to Application No. PCT/US2019/050163 dated Nov. 21, 2019.
Carter, Jr. et al., Direct Laser Sintering of Metals, General Electric Corporate Research & Development Center, pp. 51-59.
Forderhase et al., Reducing or Eliminating Curl on Wax Parts Produced in the Sinterstation 2000 System, pp. 94-101.
Jacobson et al., Practical Issues in the Application of Direct Metal Laser Sintering, Centere for Rapid Design and Manufacture, Euckinghamshire Chilterns University College, High Wycombe, Buckinghamshire, U.K., pp. 728-739.

* cited by examiner

HEAT EXCHANGERS WITH A PARTICULATE FLUSHING MANIFOLD AND SYSTEMS AND METHODS OF FLUSHING PARTICULATES FROM A HEAT EXCHANGER

FIELD

The present disclosure generally pertains to heat exchangers with a particulate flushing manifold, and systems and methods of flushing particulates from a heat exchanger.

BACKGROUND

Heat exchangers may accumulate particulates within fluid pathways or on surfaces that define a fluid pathway for various reasons. Particulates present in a heat transfer-fluid may be introduced into a fluid pathway. For example, heat transfer-fluid such as a liquid or air may include particulates such as impurities, foreign objects, debris, and the like which may accumulate within a fluid pathway. As another examples, particulates may precipitate on surfaces that define a fluid pathway, for example, forming a scale of precipitated material. Additionally, residual particulates from manufacturing processes may be present in a fluid-pathway. For example, heat exchangers fabricated using an additive manufacturing process, such as a powder bed fusion (PBF) process, may have residual powder in a fluid-pathway. Further, with an air-cooled heat exchanger, a heat transfer-fluid such as air may include dust, dirt, sand, and other debris which may be introduced through an air intake.

Regardless of their source or their rate of accumulation, particulates that accumulate within fluid pathways or on surfaces that define a fluid pathway may inhibit the performance of a heat exchanger. The particulates may inhibit the rate of heat transfer between fluids in the heat exchanger and/or restrict flow through fluid pathways within the heat exchanger. Systems and methods have been provided for cleaning particulates from a heat exchanger. For example, modular heat exchanger cleaning systems have been provided which may be coupled to a heat exchanger. A cleaning fluid may be supplied to flush the fluid pathway. Some of these systems may require disconnecting fittings or disassembling the heat exchanger before performing the cleaning.

Additionally, some heat exchangers maybe commissioned for service at locations where all or a portion of the heat exchanger may be inaccessible, for example, because of other equipment or perimeter walls surrounding the heat exchanger. Consequently, cleaning such a heat exchanger may involve added complications of disassembling or removing such other equipment. In some situations, a heat exchanger may be decommissioned and replaced rather than undergo a complicated process to access and clean the heat exchanger.

Accordingly, there exists a need for heat exchangers with a particulate flushing manifold, and systems and methods of flushing particulates from a heat exchanger.

BRIEF DESCRIPTION

Aspects and advantages will be set forth in part in the following description, or may be obvious from the description, or may be learned through practicing the presently disclosed subject matter.

In one aspect, the present disclosure embraces heat exchangers that have a body including a plurality of heat transfer pathways, and a flushing manifold integrally formed with the body of the heat exchanger. The flushing manifold may include a plurality of nozzles oriented so as to spray a flushing fluid onto one or more of the plurality of heat transfer pathways.

In another aspect, the present disclosure embraces a method of flushing particulates from a heat exchanger. An exemplary method includes supplying a flushing fluid through a flushing manifold integrally formed with a body of a heat exchanger, and spraying the flushing fluid into one or more heat transfer pathways using one or more nozzles in fluid communication with the flushing manifold.

These and other features, aspects and advantages will become better understood with reference to the following description and appended claims. The accompanying drawings, which are incorporated in and constitute a part of this specification, illustrate exemplary embodiments and, together with the description, serve to explain certain principles of the presently disclosed subject matter.

BRIEF DESCRIPTION OF THE DRAWINGS

A full and enabling disclosure, including the best mode thereof, directed to one of ordinary skill in the art, is set forth in the specification, which makes reference to the appended Figures, in which.

Figure 1A:
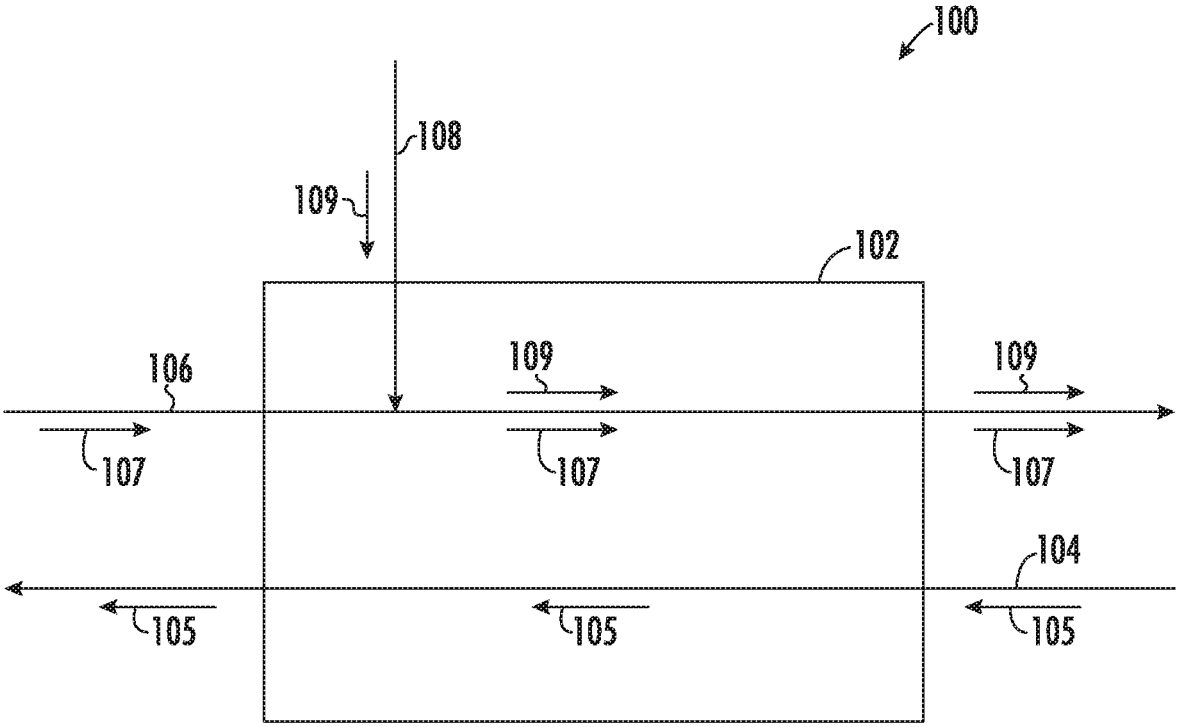
FIGS. 1A and 1B schematically show exemplary heat exchangers with a particulate flushing manifold.

Repeat use of reference characters in the present specification and drawings is intended to represent the same or analogous features or elements of the present disclosure.

DETAILED DESCRIPTION

Reference now will be made in detail to exemplary embodiments of the presently disclosed subject matter, one or more examples of which are illustrated in the drawings. Each example is provided by way of explanation and should not be interpreted as limiting the present disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

The present disclosure generally provides heat exchangers with a particulate flushing manifold integrally formed with the body of the heat exchanger, and methods of flushing particulates from a heat exchanger using such a particulate flushing manifold. The particulate flushing manifold directs a flushing fluid to be sprayed into one or more heat transfer pathways so as to wash, clean, rinse, or otherwise flush particulates from the heat transfer pathways. The flushing manifold may be used to flush particulates from the heat transfer pathways, which may accumulate from a wide variety of sources. Such particulates may include impurities, foreign objects, dust, dirt, debris, and the like which may be introduced with a heat transfer-fluid; particulates that may precipitate on surfaces that define the heat transfer pathways, for example, forming a scale of precipitated material; and/or residual particulates from manufacturing processes such as residual powder from a powder bed fusion (PBF) process.

The flushing manifold may be configured such that the heat transfer pathways may be flushed without having to first disconnect fittings or disassemble the heat exchanger, and without requiring additional space to access the heat exchanger and/or without requiring that the heat exchanger be removed from service before flushing. In some embodiments, the flushing fluid may be sprayed into the one or more heat transfer pathways while the heat exchanger remains coupled to one or more heat transfer fluid supply lines and/or while the heat exchanger remains in operation. The presently disclosed heat exchangers and methods of flushing particulates from a heat exchanger may improve heat exchanger performance by removing particulates which may otherwise inhibit heat transfer or obstruct the flow of heat transfer fluid. By removing such particulates, not only may performance be improved, but the useful life of the heat exchanger may be extended.

The flushing fluid may flush particulates from the heat transfer pathways through physical and/or chemical means. For example, the particulates may be flushed from the heat transfer pathway through the force of the flushing fluid, and/or through chemical interaction between the flushing fluid and the particulates. For purposes of clarity, the term "flush," "flushed," or "flushing" and the like are intended to include washing, cleaning, rinsing, descaling, dissolving, emulsifying, dispersing, foaming, and/or wetting, as well as other synonymous terms associated with flushing or removing particulates from a heat transfer pathway. The flushing fluid may include any fluid which may be suitable for flushing particulates from a heat transfer pathway. Exemplary flushing fluids include air, water, solvents, soaps, surfactants, emulsifiers, descaling agents, weak acids, strong acids, weak bases, and strong bases, as well as combinations thereof.

The presently disclosed heat exchangers may be commissioned for service in any setting. In one embodiment, an exemplary heat exchanger may be utilized with an environmental control system for an aircraft, which may provide auxiliary services such as air supply, thermal control, and/or cabin pressurization. For example, bleed air may be extracted from a compressor stage of a turbomachine engine, and an exemplary heat exchanger may be configured to operate as a pre-cooler, such as a bleed air pre-cooler to cool bleed air prior to being utilized by the environmental control system, or a fuel-oil heat exchanger or a fuel-cooled oil cooler. In another embodiment, a heat exchanger may be utilized to cool a cooling fluid used in connection with a turbomachine engine. For example, an exemplary heat exchanger may be configured to operate as an air-cooled oil cooler. Such an air-cooled oil cooler may utilize ram air drawn from a scoop on an aircraft and/or an air stream supplied by an auxiliary power unit (APU) such as an APU turbine to cool a fluid such as cooling oil, which cooling oil or other fluid may be used to cool a turbomachine engine. While an exemplary heat exchanger may embody a pre-cooler or an air-cooled oil cooler, it will be appreciated that these embodiments are provided by way of example and are not to be limiting. In fact, those skilled in the art may implement the presently disclosed heat exchangers and methods of flushing particulates from a heat exchanger in any desired setting, all of which are within the spirit and scope of the present disclosure.

It is understood that terms "upstream" and "downstream" refer to the relative direction with respect to fluid flow in a fluid pathway. For example, "upstream" refers to the direction from which the fluid flows, and "downstream" refers to the direction to which the fluid flows. It is also understood that terms such as "top", "bottom", "outward", "inward", and the like are words of convenience and are not to be construed as limiting terms. As used herein, the terms "first", "second", and "third" may be used interchangeably to distinguish one component from another and are not intended to signify location or importance of the individual components. The terms "a" and "an" do not denote a limitation of quantity, but rather denote the presence of at least one of the referenced item.

Here and throughout the specification and claims, range limitations are combined and interchanged, and such ranges are identified and include all the sub-ranges contained therein unless context or language indicates otherwise. For example, all ranges disclosed herein are inclusive of the endpoints, and the endpoints are independently combinable with each other.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems.

Figure 1B:
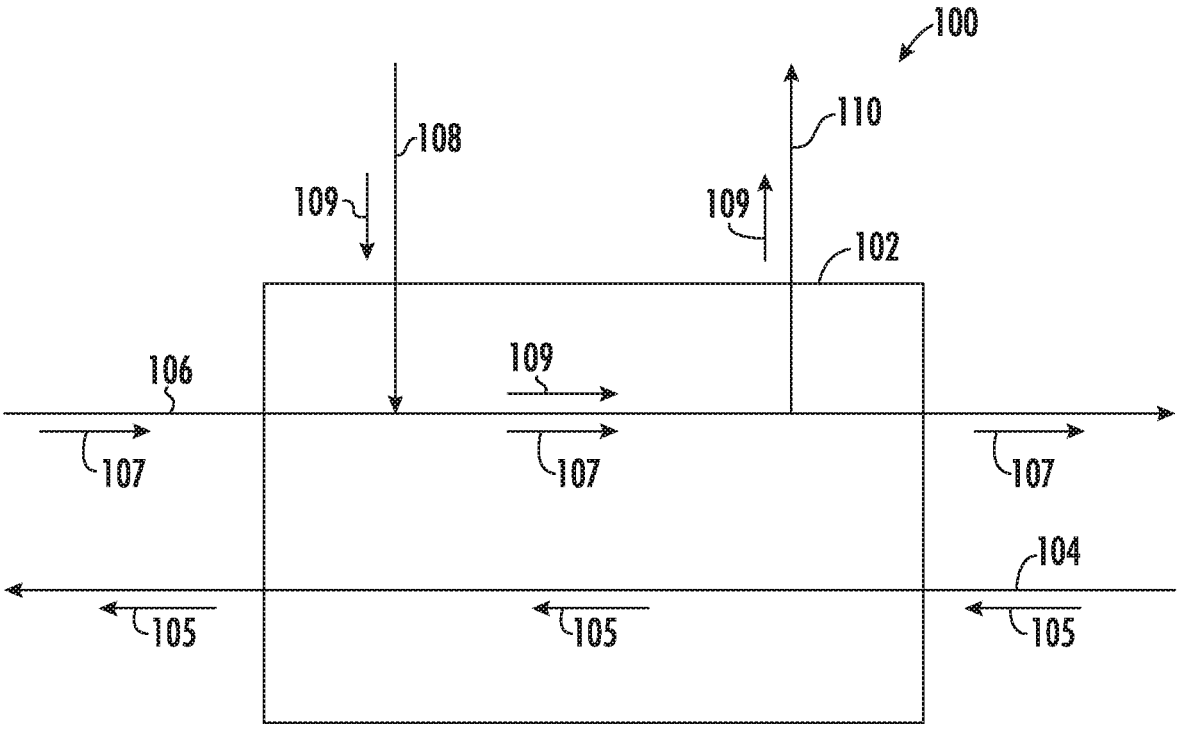

Various embodiments of the present disclosure will now be described in greater detail. Referring to FIGS. 1A and 1B, an exemplary heat exchanger 100 is shown. The exemplary heat exchanger 100 includes a body 102, within which are disposed pathways for at least two heat transfer fluids to flow therethrough. As shown, a first fluid-pathway 104 directs a first heat transfer-fluid 105 to flow through the body 102 and a second fluid-pathway 106 directs a second heat transfer-fluid 107 to flow through the body 102, with the body 102 separating the first heat transfer-fluid 105 from the second heat transfer-fluid 107. The body 102 of the heat exchange may be coupled to at least one heat transfer-fluid supply line (not shown), such as a first supply line configured to supply the first heat-transfer fluid 105 to the first fluid-pathway 104, and/or a second supply line configured to supply the second heat-transfer fluid 107 to the second fluid-pathway 106. The first heat transfer-fluid 105 may be a relatively hot fluid and the second heat transfer-fluid 107 may be a relatively cool fluid, or vice versa. Heat may transfer between the first heat transfer-fluid 105 and the second heat transfer-fluid 107, for example, through thermal conduction with the body 102 of the heat exchanger 100.

The body 102 additionally includes a flushing-pathway 108. As shown, the flushing-pathway 108 may be configured to spray a flushing fluid 109 into the second fluid-pathway 106 so as to flush particulates and the like from the second fluid-pathway 106. Additionally, or in the alternative, the flushing-pathway 108 may be configured to spray a flushing fluid 109 into the first fluid-pathway 104 so as to flush particulates and the like from the first fluid-pathway 104. In some embodiments, the flushing fluid 109 may be discharged through the second fluid-pathway 106. Alternatively, or in addition, as shown in FIG. 1B, the body 102 may include a discharge-pathway 110 configured to discharge the flushing fluid 109. A flushing fluid 109 may be introduced to a fluid-pathway (e.g., the second fluid-pathway 106) through the flushing-pathway 108 and, after flowing through at least a portion of the fluid pathway, the flushing fluid 109 may be discharged through the second fluid-pathway 106 (FIG. 1A) or the discharge pathway 110 (FIG. 1B).

The embodiments shown in FIGS. 1A and 1B include two fluid-pathways (i.e., the first fluid-pathway 104 and the second fluid-pathway 106) and one flushing-pathway 108; however, it will be appreciated that additional fluid-pathways and/or flushing-pathways may be provided without departing from the spirit or scope of the present disclosure. For example, any desired number of fluid-pathways and/or flushing-pathways 108 may be provided, including three, four, five, or more fluid-pathways and/or flushing-pathways 108. In one embodiment, a first flushing-pathway may be configured to spray a flushing fluid 109 into the first fluid pathway 104 and a second flushing-pathway may be configured to spray a flushing fluid 109 into the second fluid-pathway 106.

The heat exchanger 100 may have any desired configuration suitable to transfer heat from the first heat transfer-fluid 105 in the first fluid-pathway 104 to the second fluid in the second-fluid pathway 106. Suitable heat exchangers include shell-and-tube, plate-and-shell, plate-fin, ad three-dimensional lattice configurations, and the like. In some embodiments, the heat exchanger 100 may be an air-cooled oil cooler. In some embodiments, the heat exchanger 100 may be an air pre-cooler. In some embodiments, the heat exchanger 100 may be a fuel-oil heat exchanger or a fuel-cooled oil cooler.

An exemplary heat exchanger 100 according to one embodiment is shown in FIGS. 2A-2D. The exemplary heat exchanger 100 includes a first-fluid pathway 104, a second-fluid pathway 106, a flushing-pathway 108, and one or more heat transfer pathways 300 (FIG. 3) that encompass at least a portion of the first fluid pathway 104 and/or the second fluid pathway 106. As shown in FIGS. 2A-2D, the exemplary heat exchanger 100 includes a flushing manifold 200 that defines the flushing-pathway 108. The flushing manifold 200 may be integrally formed with the body 102 of the heat exchanger 100. The exemplary heat exchanger 100 has a back side 112 and a front side 114, and in some embodiments the flushing-pathway 108 may be configured to spray a flushing fluid 109 with a back-to-front directionality. The flushing manifold 200 includes an inlet 202 that provides access for a flushing fluid 109 to be introduced into the heat transfer pathways 300, such as the second fluid-pathway 106. In some embodiments, the flushing manifold 200 may include a supply header 204 and one or more distribution pathways 206. Any number of distribution pathways 206 may be provided. For example, a number of distribution pathways 206 may be selected so as to adequately distribute flushing fluid 109 to various portions of the heat transfer pathways 300. As shown, an exemplary flushing manifold 200 may include a plurality of distribution pathways 206, such as a first distribution pathway 208, a second distribution pathway 210, and a third distribution pathway 212.

Figure 2A:
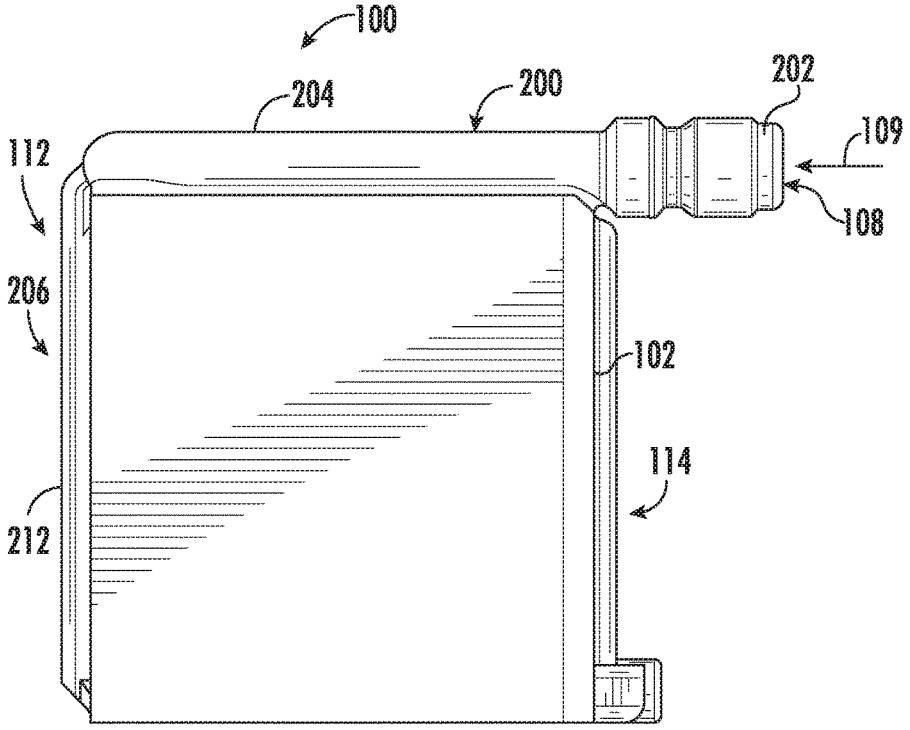
FIGS. 2A-2D show perspective views of an exemplary heat exchanger with a particulate flushing manifold.
Figure 2B:
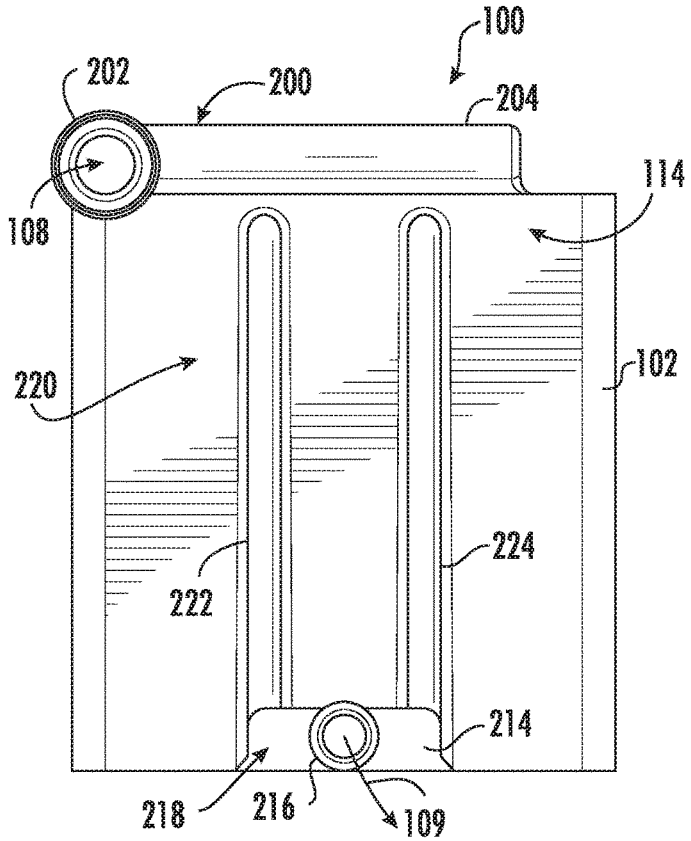
Figure 2C:
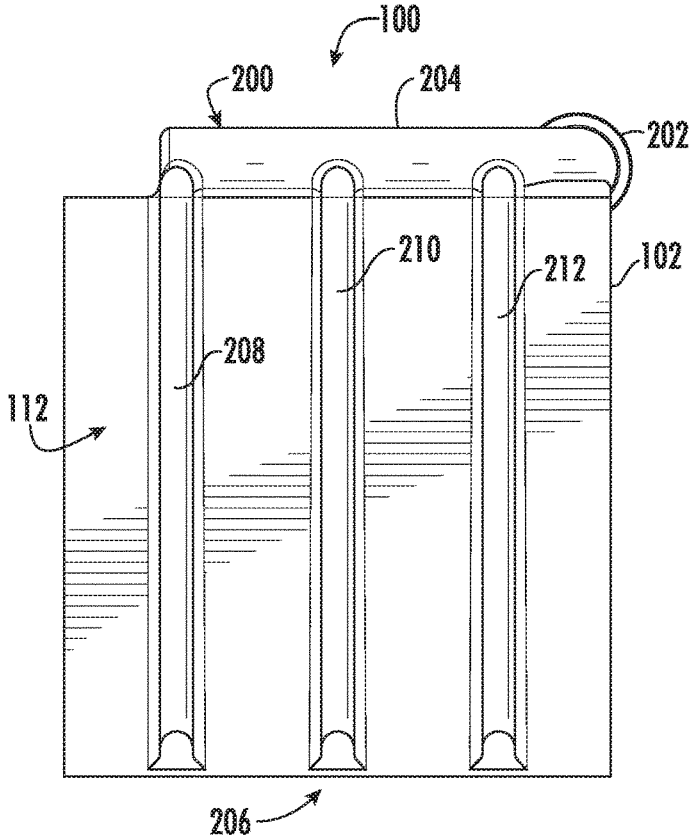
Figure 2D:
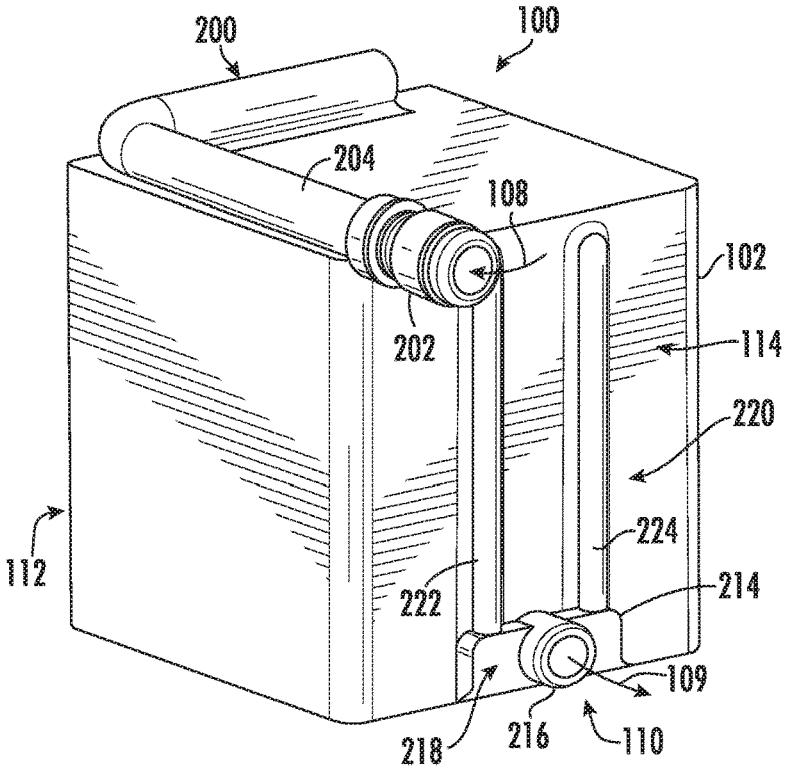

In some embodiments, as shown in FIGS. 2B and 2D, an exemplary heat exchanger may include a discharge manifold 214. As shown, the discharge manifold 214 may be integrally formed with the body 102 of the heat exchanger 100. The discharge manifold 214 includes an outlet 216 for a flushing fluid 109 to be discharged from the one or more heat transfer pathways 300, such as through a discharge-pathway 110. In some embodiments, the discharge manifold 214 may include a discharge header 218 and a plurality of collection pathways 220. Any number of collection pathways 220 may be provided. For example, a number of collection pathways 220 may be provided so as to collect flushing fluid 109 from various portions of a fluid pathway. As shown, an exemplary discharge manifold 214 may include a plurality of collection pathways 220, such as a first collection pathways 222 and a second collection pathways 224.

Figure 3:
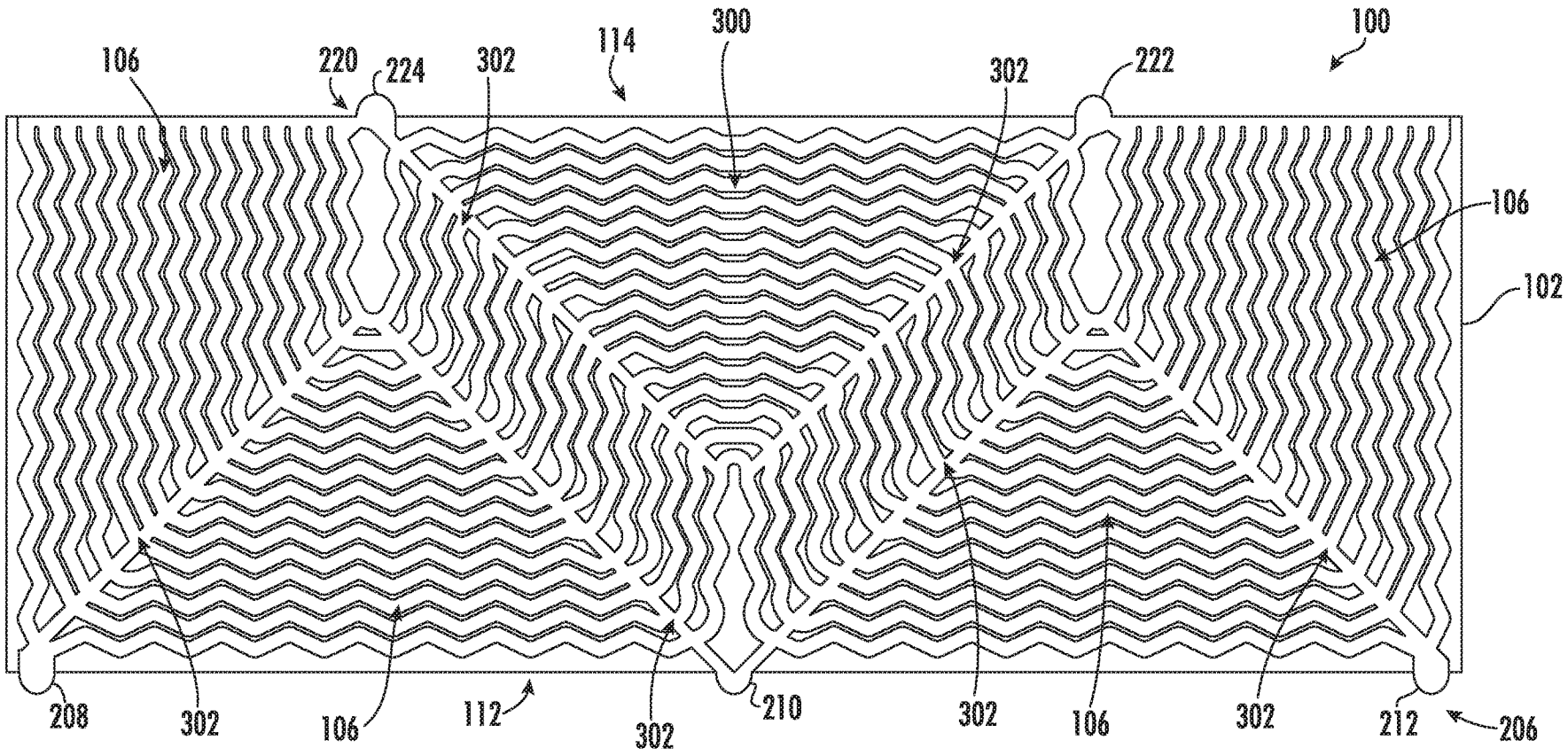
FIG. 3 shows a cross-sectional view of the exemplary heat exchanger of FIGS. 2A-2D.
Figure 4A:
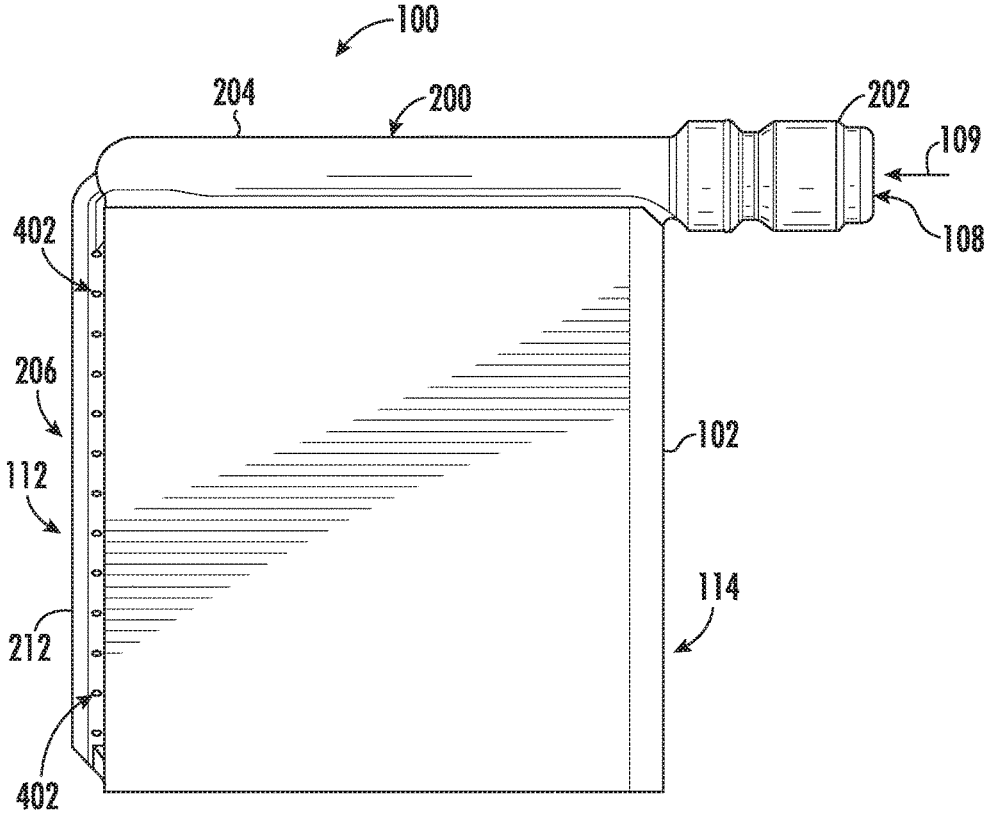
FIGS. 4A-4D show perspective views of another exemplary heat exchanger with a particulate flushing manifold.
Figure 4B:
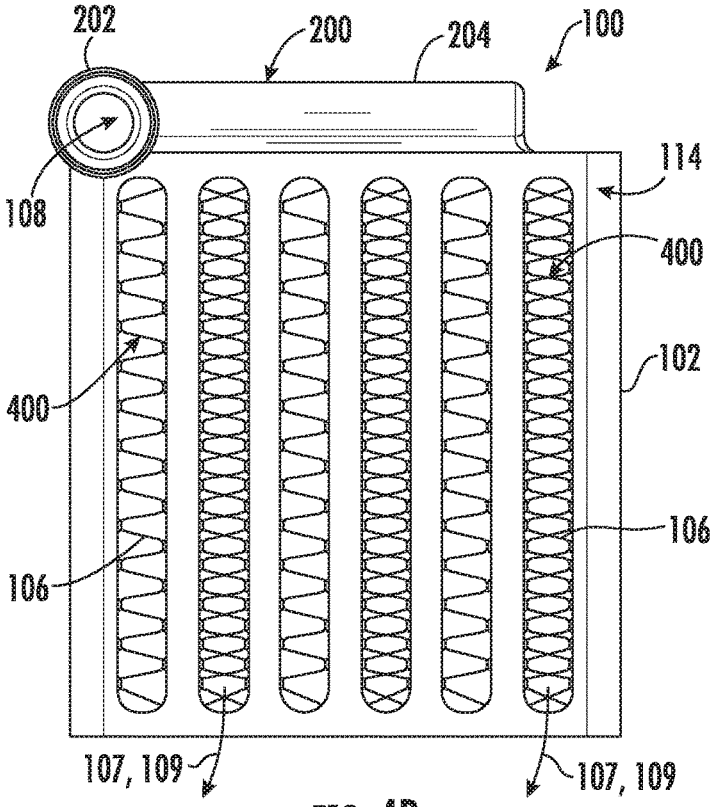
Figure 4C:
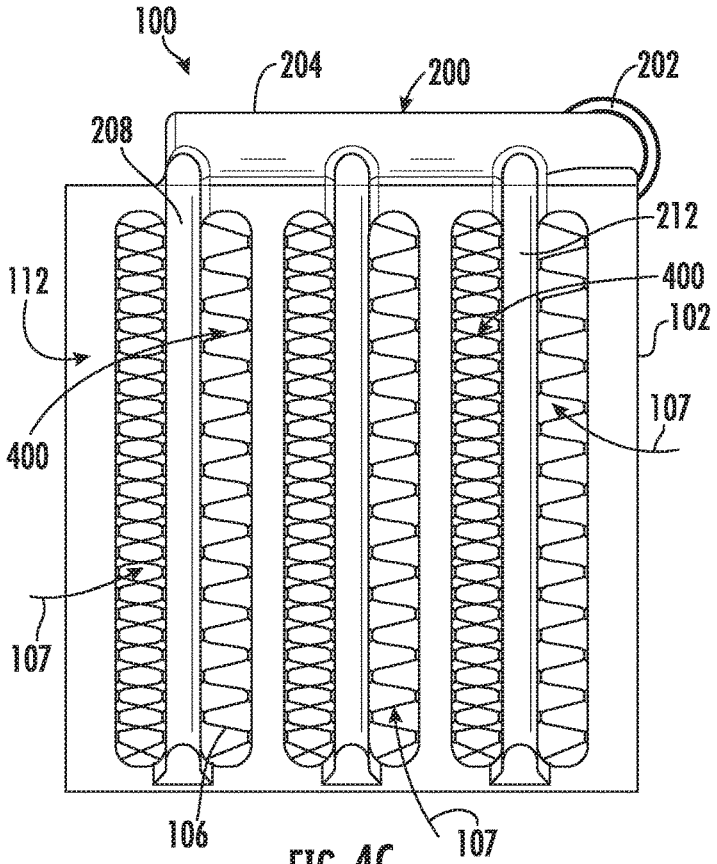
Figure 4D:
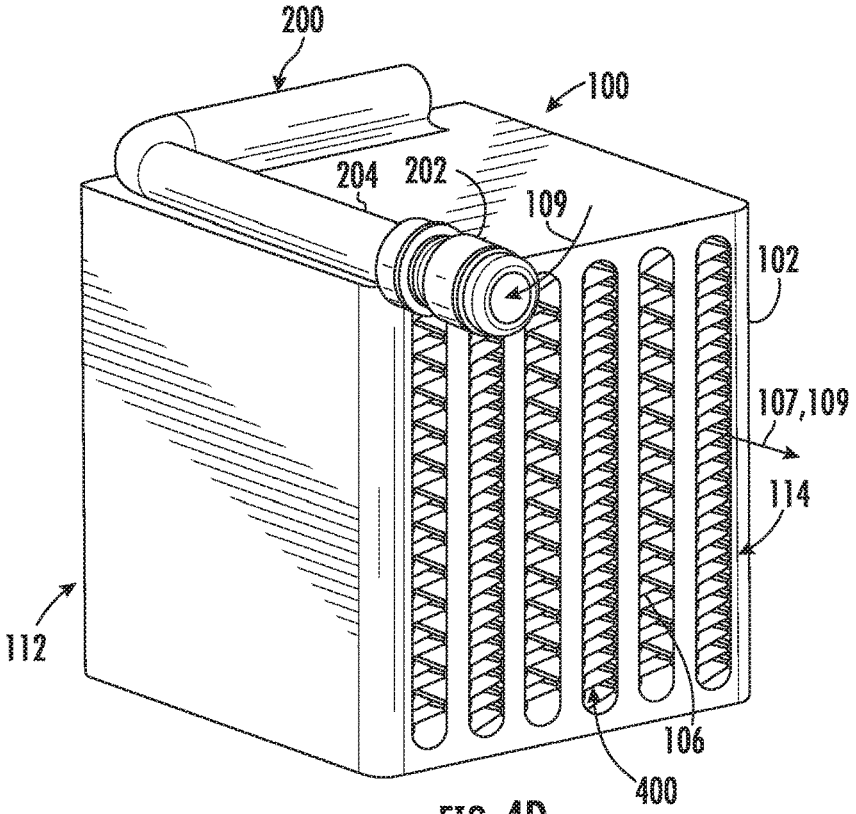

FIG. 3 shows a cross-sectional view of the exemplary heat exchanger 100 of FIGS. 2A-2D. As shown, the body 102 of the heat exchanger 100 may include a series of heat transfer pathways 300 that define a pathway for a heat transfer fluid to flow therethrough. The series of heat transfer pathways 300 may include at least a portion of the second fluid-pathway 106. Additionally, or in the alternative, a series of heat transfer pathways 300 may include at least a portion of the first fluid-pathway 104 (not shown). The heat transfer pathways 300 may have any desired configuration. In some embodiments, a heat transfer pathway 300 may include a three-dimensional lattice structure that includes an array of interconnected pathways. In some embodiments, an heat transfer pathway 300 may include an array of tubes, channels, or other pathway, such as those found in shell-and-tube or plate-and-shell heat exchangers. The heat transfer pathways 300 may be in fluid communication one or more distribution pathways 206 and/or one or more collection pathways 220. The heat transfer pathways 300 may include one or more flushing channels 302. The flushing channels 302 may traverse at least a portion of the heat transfer pathways 300. In some embodiments, the flushing channels 302 may be positioned at locations where particulates may tend to accumulate, such as at corners of the heat transfer pathways 300. Flushing fluid 109 introduced into the flushing-pathway 108 may flow through the heat transfer pathways 300 and/or through the flushing channels 302, thereby flushing particulates from such heat transfer pathways 300 and/or flushing channels 302.

Another exemplary heat exchanger 100 is shown in FIGS. 4A-4D. The exemplary heat exchanger 100 includes a first-fluid pathway 104, a second-fluid pathway 106, a flushing-pathway 108, and one or more heat transfer pathways 300 (FIG. 5) that encompass at least a portion of the first fluid pathway 104 and/or the second fluid pathway 106. In one embodiment an exemplary heat exchanger 100 may include an array of heat transfer fins 400. As shown in FIGS. 4A-4D, and FIG. 5, the heat transfer fins 400 may define a series of heat transfer pathways 300 for a heat transfer fluid. For example, a series of heat transfer pathways 300 may include at least a portion of the second fluid-pathway 106. Additionally, or in the alternative, a series of heat transfer pathways 300 may include at least a portion of the first fluid-pathway 104 (not shown).

As shown in FIGS. 4A-4D, the exemplary heat exchanger 100 includes a flushing manifold 200 that defines the flushing-pathway 108. The exemplary heat exchanger 100 has a back side 112 and a front side 114, and in some embodiments the flushing-pathway 108 may be configured to spray a flushing fluid 109 with a back-to-front directionality. The flushing manifold 200 may be integrally formed with the body 102 of the heat exchanger 100. The flushing manifold 200 includes an inlet 202 that provides access for a flushing fluid 109 to be introduced into the series of heat transfer pathways 300, such as the second fluid-pathway 106, through a plurality of nozzles 402. In some embodiments, the flushing manifold 200 may include a supply header 204 and a plurality of distribution pathways 206. Any number of distribution pathways 206 may be provided. For example, a number of distribution pathways 206 may be selected so as to adequately distribute flushing fluid 109 to various portions of the series of heat transfer pathways 300. As shown, an exemplary flushing manifold 200 may include a plurality of distribution pathways 206, such as a first distribution pathway 208, a second distribution pathway 210, and a third distribution pathway 212.

Figure 5:
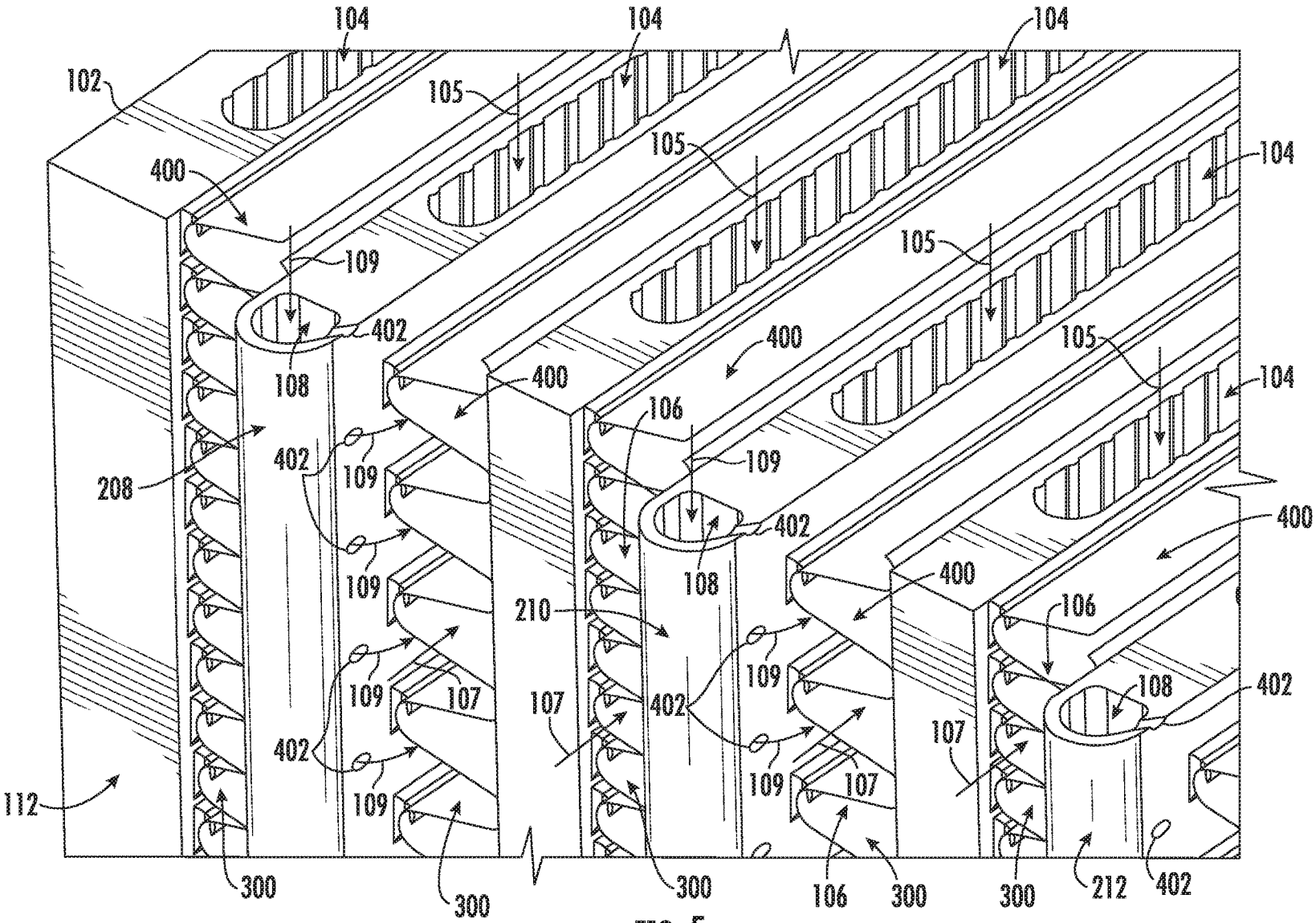
FIG. 5 shows a perspective cut-away view of the exemplary heat exchanger of FIGS. 4A-4D.

FIG. 5 shows a perspective cut-away view of the exemplary heat exchanger of FIGS. 4A-4D. As shown, the exemplary heat exchanger 100 has a crossflow arrangement. However, it will be appreciated that the present disclosure embraces heat exchangers with any flow arrangement or combination thereof, including parallel flow arrangements, counterflow arrangements, cross-counterflow arrangements, and countercurrent arrangements. Additionally, the heat transfer fins 400 and corresponding heat transfer pathways 300 may have any desired configuration. Exemplary heat transfer fins 400 include generally planar or corrugated surfaces with a straight or curvilinear profile, as well as multifaceted surfaces with herringbones, ridges, corners, or the like. In some embodiments, the heat transfer fins 400 may include perforated or serrated surfaces (not shown), which may redistribute a heat transfer-fluid among the series of heat transfer pathways 300 defined by the heat transfer fins 400.

Figure 6A:
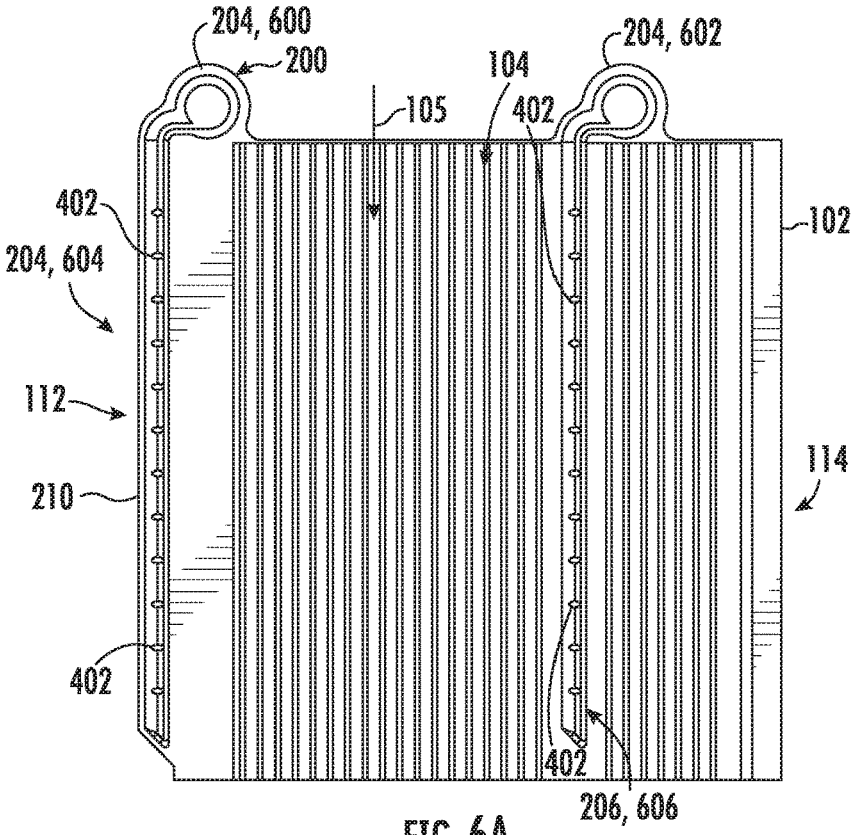
FIGS. 6A and 6B show cross-sectional views of another exemplary particulate flushing manifold.
Figure 6B:
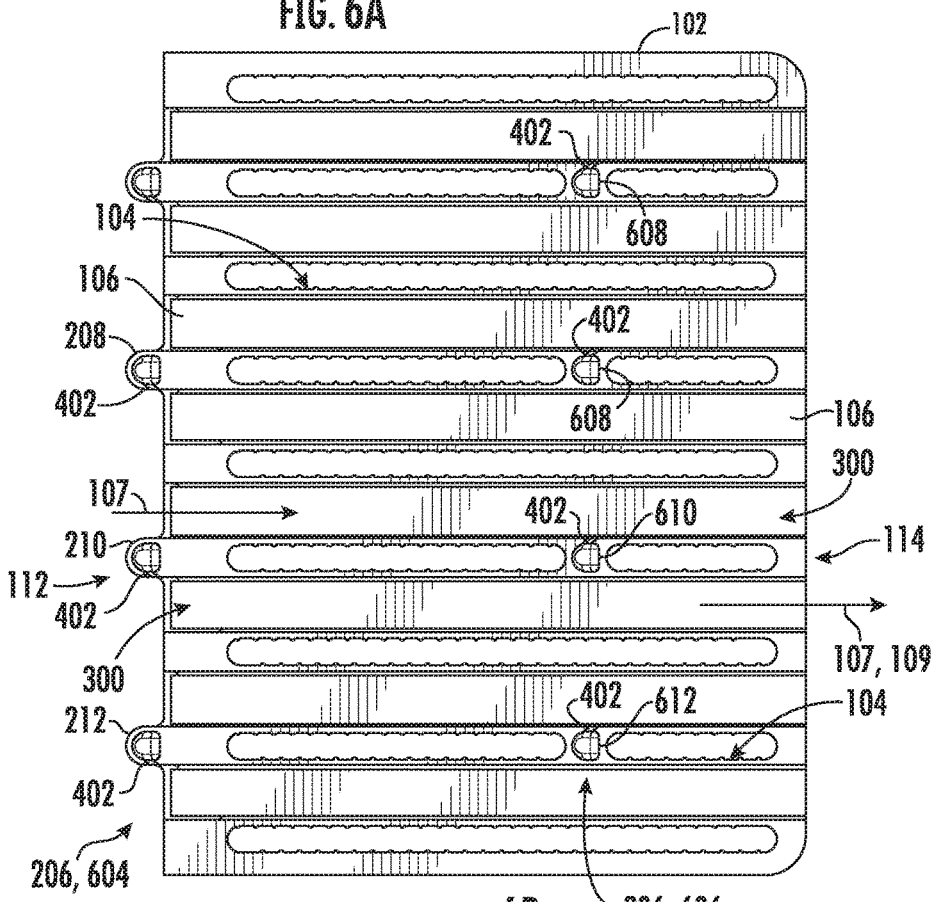

In some embodiments, as shown in FIGS. 6A and 6B, an exemplary flushing manifold 200 may include a plurality of supply headers 204, each with a plurality of distribution pathways 206. For example, an exemplary heat exchanger 100 may include a first supply header 204, 600 and a second supply header 204, 602. The first supply header 204, 600 may include a plurality of first distribution pathways 206, 604 and the second supply header 204, 602 may include a plurality of second distribution pathways 206, 606. The first supply header 204, 600 may include a first distribution pathway 208, a second distribution pathway 210, and a third distribution pathway 212. The second supply header 204, 602 may include a fourth distribution pathway 608, a fifth distribution pathway 610, and a sixth distribution pathway 612. The first supply header 204, 600 and/or the second supply header 204, 602 may include a plurality of distribution pathways 604, 606 positioned at locations selected so as to effectively flush particulates from the heat transfer pathway 300. For example, a first plurality of distribution pathways 604 may include a plurality of nozzles 402 configured to flush particulates from a first portion of the heat transfer pathway 300, and a second plurality of distribution pathways 606 may include a plurality of nozzles 402 configured to flush particulates from a second portion of the heat transfer pathway 300.

The plurality of distribution pathways 206, 604 may be configured to flush particulates from the heat transfer pathway 300 in the same direction as the heat transfer fluid (e.g., the second heat transfer-fluid 107) flows through the heat transfer pathway 300, or in the opposite direction as the heat transfer fluid flows through the heat transfer pathway 300. As shown, the nozzles 402 are configured to spray flushing fluid 109 in the same direction as the second heat transfer-fluid 107 flows through the second fluid-pathway 106. In some embodiments one or more nozzles 402 may be oriented so as to spray flushing fluid 109 with a back-to-front directionality, such as from a back side 112 of the heat exchanger 100 to a front side 114 of the heat exchanger 100. Such back-to-front flow may be desirable, for example, when access is limited or unavailable around the of the heat exchanger 100. Such access may be limited, for example when the back side 112 of the heat exchanger 100 is coupled to related systems such as an intake manifold, ductwork, piping, or the like. As further examples, such access around the back side 112 of the heat exchanger 100 may be limited when the heat exchanger 100 is situated in close proximity to other equipment and/or a perimeter wall.

Alternatively, or in addition, at least a portion of the nozzles 402 may be configured to spray flushing fluid 109 in the opposite direction as the heat transfer fluid (e.g., the second heat transfer-fluid 107) flows through the second fluid-pathway 106, and the flushing fluid 109 may flow with a front-to-back directionality, such as from a front side 114 of the heat exchanger 100 to a back side 112 of the heat exchanger 100. Such front-to-back flow may be desirable, for example, when particulates tend to accumulate near the back side of the heat exchanger 100. In some embodiments, a front-to-back flow directionality may offer a shorter path for flushing the particulates from the heat transfer pathways 300, which may reduce the tendency for particulates to become lodged within the heat transfer pathways 300 or for particulates to damage the heat transfer pathway 300 when flushing. In some embodiments, a heat exchanger 300 may be equipped with a first plurality of nozzles 402 configured to flush in a back-to-front directionality and a second plurality of nozzles configured to flush in a front-to-back directionality.

Figure 7A:
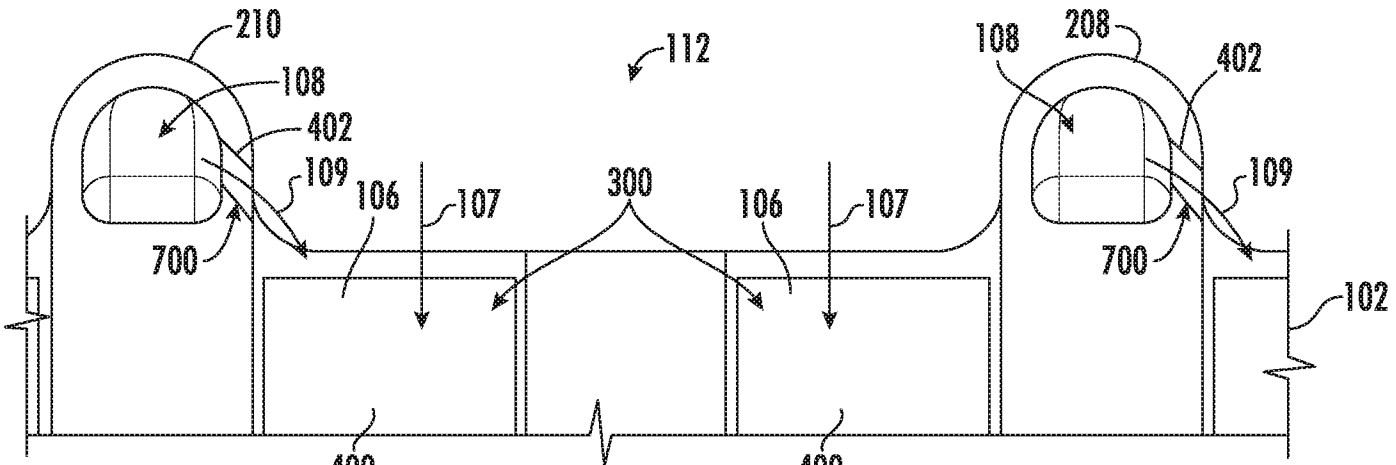
FIGS. 7A and 7B show cross-sectional view of exemplary nozzles for a particulate flushing manifold.
Figure 7B:
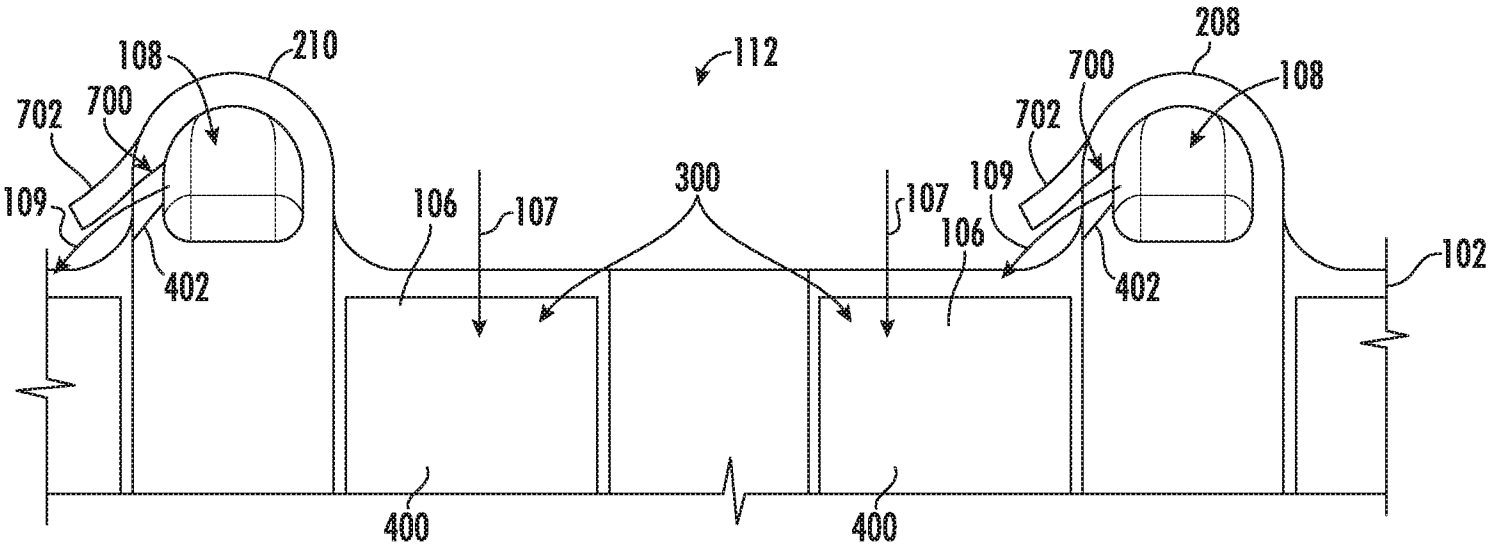

FIGS. 7A and 7B show cross-sectional view of exemplary nozzles 402 which may be included as part of a particulate flushing manifold. In some embodiments, a nozzle 402 may include one or more channels 700 formed in the a distribution pathway 206 or other portion of the flushing manifold 200. The channels 700 may include any cross-sectional profile or shape as may be desired to direct flushing fluid 109 into the heat transfer pathways 300. As shown, the nozzles 402 are integrally formed as part of the flushing manifold 200. However, it will be appreciated that nozzles may also be provided as a separate component configured to be coupled to holes in the particulate flushing manifold, such as through a threaded interface, welding, brazing, or the like.

The nozzles 402 may be configured to direct one or more jets of flushing fluid 109 onto one or more surfaces of the of the heat transfer pathways 300. The nozzles 402 may provide a jet of fluid having a desired rate of flow, velocity, direction, pressure, and/or shape. The nozzles 402 may be disposed about the flushing manifold 200 such as along a length of distribution pathways 206 in any desired configuration or orientation. For example, an array of nozzles 402 may be distributed along a length of the distribution pathways 206 such that a spray of flushing fluid 109 from the nozzles 402 adequately covers the series of heat transfer pathways 300. The spray from a particular nozzle 402 generally may be associated with a single heat transfer pathway 300 and/or the spray from a particular nozzle 402 may overlap a plurality of heat transfer pathways 300.

The flushing fluid 109 may be ejected from the nozzles 402 at any desired pressure ranging from a gentle flush to a high-pressure spray. A relatively gentle flush may be utilized for removing loose debris such as dust, dirt, or sand, while a relatively high-pressure spray may be utilized for removing scale or other precipitated material. In some embodiments, a flushing manifold 200 may include nozzles 402 configured to eject flushing fluid 109 at a pressure ranging from 50 to 25,000 psi. A nozzle 402 may provide a relatively gentle flush with flushing fluid 109 ejecting from the nozzle 402 at a pressure ranging from 50 to 1,000 psi, such as from 50 to 100 psi, such as from 100 to 500 psi, such as from 75 to 150 psi, such as from 250 to 750 psi, or such as from 500 to 1,000 psi. The flushing fluid 109 may be ejected from a nozzle 402 at a pressure of at least 50 psi, such as at least 75 psi, such as at least 100 psi, such as at least 150 psi, such as at least 250 psi, such as at least 500 psi, or such as at least 750 psi. The flushing fluid 109 may be ejected from a nozzle 402 at a pressure that is less than 1,000 psi, such as 850 psi or less, such as 600 psi or less, such as 350 psi or less, such as 275 psi or less, such as 120 psi or less, or such as 85 psi or less.

A nozzle 402 may provide a relatively high-pressure jet with flushing fluid 109 ejecting from the nozzle 402 at a pressure ranging from 1,000 to 25,000 psi, such as from 1,000 to 5,000 psi, such as from 1,500 to 4,000 psi, such as from 2,500 to 3,500 psi, such as from 5,000 psi to 25,000 psi, such as from 5,000 psi to 10,000 psi, such as from 10,000 psi to 20,000 psi, or such as from 15,000 psi to 25,000 psi. The flushing fluid 109 may be ejected from a nozzle 402 at a pressure of at least 1,000 psi, such as at least 1,250 psi, such as at least 1,500 psi, such as at least 2,500 psi, such as at least 3,000 psi, such as at least 4,000 psi, such as at least 5,000 psi, such as at least 10,000 psi, such as at least 15,000 psi, or such as at least 20,000 psi. The flushing fluid may be ejected from a nozzle 402 at a pressure that is less than 25,000 psi, such as 22,000 psi or less, such as 18,000 psi or less, such as 14,000 psi or less, such as 11,000 psi or less, such as 8,000 psi or less, such as 6,000 psi or less, such as 4,500 psi or less, such as 3,500 psi or less, such as 2,800 psi or less, such as 2,200 psi or less, such as 1,800 psi or less, or such as 1,400 psi or less.

Figure 8:
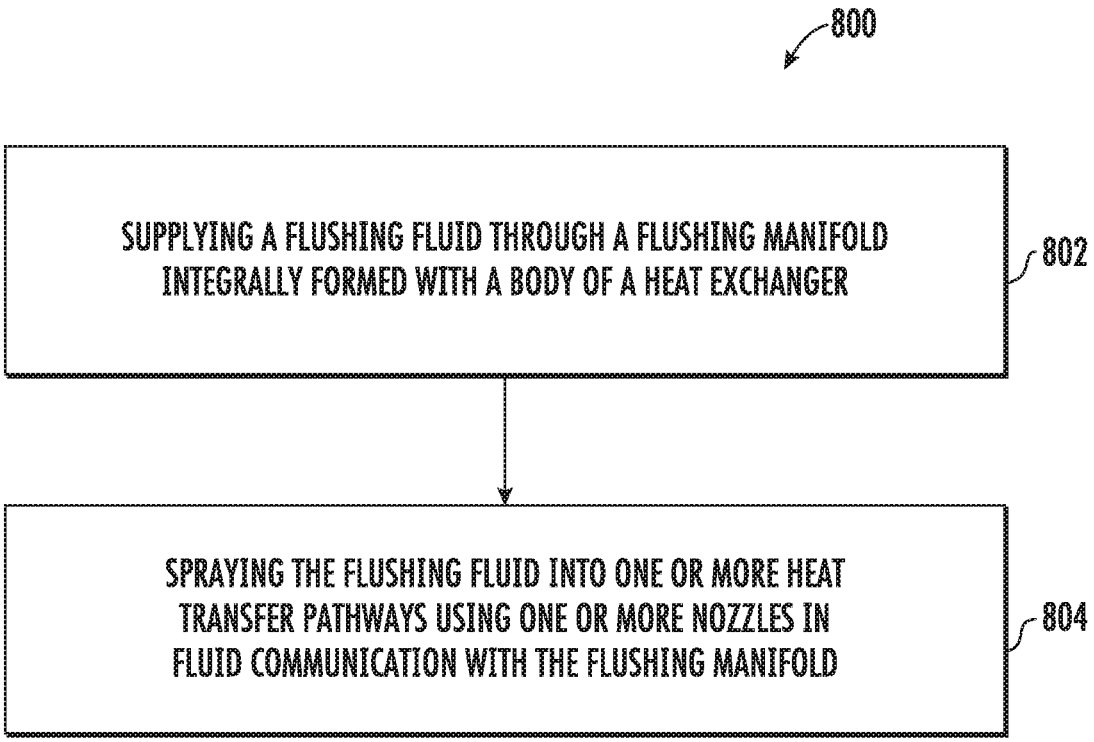
FIG. 8 shows a flowchart depicting an exemplary method of flushing particulates from a heat exchanger.

Now turning to FIG. 8, exemplary methods of flushing particulates from a heat exchanger will be discussed. An exemplary method 800 includes supplying a flushing fluid through a flushing manifold integrally formed with a body of a heat exchanger 802 and spraying the flushing fluid into one or more heat transfer pathways using one or more nozzles in fluid communication with the flushing manifold 804. The exemplary method 800 may be performed to remove particulates from the one or more heat transfer pathways that may originate from a variety of different sources. Such particulates may include impurities, foreign objects, dust, dirt, debris, and the like which may be introduced with a heat transfer-fluid; particulates that may precipitate on surfaces that define a fluid pathway, for example, forming a scale of precipitated material; and/or residual particulates from manufacturing processes such as residual powder from a powder bed fusion (PBF) process.

Regardless of the source of the particulates, the exemplary method 800 may include accumulating debris within the one or more heat transfer pathways and flushing the debris from the one or more heat transfer pathways by spraying the flushing fluid into the one or more heat transfer pathways. The debris may be accumulated while manufacturing the heat exchanger and/or while operating the heat exchanger. The flushing fluid 109 may be sprayed through the one or more heat transfer pathways 300 with a back-to-front directionality and/or with a front-to-back directionality. Additionally, or in the alternative, the exemplary method 800 may include periodically flushing the one or more heat transfer pathways by spraying the flushing fluid into the one or more heat transfer pathways, the flushing performed with a periodicity selected so as to keep the heat transfer pathways substantially free of particulates.

With the flushing manifold 200 configured as described herein, the flushing fluid 109 may be sprayed into the one or more heat transfer pathways 300 while the heat exchanger 100 remains operable. The flushing fluid 109 may be spayed into the one or more heat transfer pathways 300 while the heat exchanger 100 remains coupled to at least one supply line configured to supply heat transfer fluid to a pathway disposed within the body of the heat exchanger. For example, the heat exchanger may be coupled to a heat transfer-fluid supply line (not shown) configured to supply a first heat transfer-fluid 105 to the first fluid-pathway 104, and/or the heat exchanger may be coupled to a heat transfer-fluid supply line (not shown) configured to supply a second heat transfer-fluid 107 to the second fluid-pathway 106.

Further, in some embodiments, the flushing fluid 109 may be sprayed into the one or more heat transfer pathways 300 while the heat exchanger 100 remains in operation. The flushing fluid 1098 may be sprayed into the one or more heat transfer pathways 300 while the heat transfer fluid flows through a pathway disposed within the body of the heat exchanger 100 such as the one or more heat transfer pathways 300. For example, the flushing fluid 109 may be sprayed into the one or more heat transfer pathways 300 while the first heat transfer-fluid 105 flows through the first fluid-pathway 104 and/or while the second heat transfer-fluid 107 flows through the second fluid-pathway 106. The one or more heat transfer pathways 300 may include at least a portion of the first fluid-pathway 104 and/or at least a portion of the second fluid-pathway 106. In some embodiments, the flushing fluid 109 may become at least partially mixed with heat transfer fluid upon the flushing fluid 109 having been sprayed through the one or more nozzles 402 into the one or more heat transfer pathways 300. For example, the flushing fluid 109 may become at least partially mixed with the first heat transfer-fluid 105 when the flushing manifold 200 is configured to spray the flushing fluid 109 into the first fluid-pathway 104. The flushing fluid 109 may become at least partially mixed with the second heat transfer-fluid 107 when the flushing manifold 200 is configured to spray the flushing fluid 109 into the second fluid-pathway 106.

In some embodiments, the exemplary method may include additively-manufacturing a heat exchanger 100 using an additive manufacturing process that leaves residual powder within the one or more heat transfer pathways 300, and flushing the residual powder from the one or more heat transfer pathways 300 by spraying the flushing fluid 109 into the one or more heat transfer pathways 300. The additive manufacturing process may include a powder bed fusion (PBF) process, such as a direct metal laser melting (DMLM) process, an electron beam melting (EBM) process, a selective laser melting (SLM) process, a directed metal laser sintering (DMLS) process, or a selective laser sintering (SLS) process. In some embodiments, the flushing manifold 200 may be used to flush residual powder from the one or more heat transfer pathways 300 and then the flushing manifold 200 may be subsequently removed from the heat exchanger 100, such as prior to commissioning the heat exchanger 100 for service. The exemplary method 800 may include cutting the flushing manifold 200 from the body 102 of the heat exchanger 100 after flushing the residual powder from the one or more heat transfer pathways 300. In some embodiments, one or more holes may be introduced into the body 102 of the heat exchanger 100 through the step of cutting the flushing manifold 200 from the body 102 of the heat exchanger 100. The exemplary method 800 may include sealing a hole in the body 102 of the heat exchanger 100 introduced from cutting the flushing manifold 200 from the body 102 of the heat exchanger 100.

In some embodiments, an exemplary heat exchanger 100 may include a discharge manifold 214, and the exemplary method 800 may include cutting the discharge manifold 214 from the body 102 of the heat exchanger 100 after flushing the residual powder from the one or more heat transfer pathways 300. In some embodiments, one or more holes may be introduced into the body 102 of the heat exchanger 100 through the step of cutting the discharge manifold 214 from the body 102 of the heat exchanger 100. The exemplary method 800 may include sealing a hole in the body 102 of the heat exchanger 100 introduced from cutting the discharge manifold 214 from the body 102 of the heat exchanger 100.

This written description uses exemplary embodiments to describe the presently disclosed subject matter, including the best mode, and also to enable any person skilled in the art to practice such subject matter, including making and using any devices or systems and performing any incorporated methods. The patentable scope of the presently disclosed subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heat exchanger, comprising:

a body comprising a first side and a second side opposite the first side, and an array of heat transfer fins defining a plurality of heat transfer pathways for transferring heat, the plurality of heat transfer pathways comprising a three-dimensional lattice structure having an array of interconnected pathways;

a flushing manifold integrally formed with the body of the heat exchanger, the flushing manifold having a plurality of distribution pathways positioned at the second side of the body, a supply header, and a plurality of nozzles oriented relative the body so as to spray a flushing fluid onto, into, or both onto and into one or more of the plurality of heat transfer pathways, the plurality of nozzles disposed along the plurality of distribution pathways; and a discharge manifold integrally formed with the body of the heat exchanger, the discharge manifold positioned at the first side of the body, the discharge manifold comprising an outlet configured to discharge the flushing fluid from the one or more of the plurality of heat transfer pathways.

2. The heat exchanger of claim 1, wherein at least one of the nozzles of the plurality of nozzles is configured to spray the flushing fluid with a back-to-front directionality relative the body.

3. The heat exchanger of claim 1, wherein the heat exchanger comprises a shell-and-tube heat exchanger or a plate-and-shell heat exchanger.

4. The heat exchanger of claim 1, wherein the heat exchanger comprises an array of heat transfer fins disposed within the body of the heat exchanger.

5. The heat exchanger of claim 1, wherein the flushing manifold comprises a plurality of supply headers, each of the supply headers comprising a portion of the plurality of distribution pathways, and wherein the plurality of nozzles are disposed along the plurality of distribution pathways.

6. The heat exchanger of claim 1, comprising:

a first fluid-pathway configured to direct a first heat transfer-fluid to flow through the body of the heat exchanger, and a second fluid-pathway configured to direct a second heat transfer-fluid to flow through the body of the heat exchanger, the body separating the first heat transfer-fluid from the second heat transfer-fluid; and a flushing-pathway comprising the flushing manifold and the plurality of nozzles, the flushing-pathway configured to spray the flushing fluid onto, into, or both onto and into the first fluid-pathway, the second fluid-pathway, or both the first fluid-pathway and the second fluid-pathway.

7. The heat exchanger of claim 1, wherein the heat exchanger comprises an air-cooled oil cooler, a fuel-cooled oil cooler, or a bleed air pre-cooler.

* * * * *